US010468819B2

(12) United States Patent
Tsukahara

(10) Patent No.: US 10,468,819 B2
(45) Date of Patent: Nov. 5, 2019

(54) CONNECTOR

(71) Applicant: JUNKOSHA INC., Ibaraki (JP)

(72) Inventor: Yuta Tsukahara, Ibaraki (JP)

(73) Assignee: JUNKOSHA INC., Kasama-Shi, Ibaraki (JP)

( * ) Notice: Subject to any disclaimer, the term of this patent is extended or adjusted under 35 U.S.C. 154(b) by 0 days.

(21) Appl. No.: 15/511,949

(22) PCT Filed: Sep. 16, 2015

(86) PCT No.: PCT/JP2015/076368
§ 371 (c)(1),
(2) Date: Mar. 16, 2017

(87) PCT Pub. No.: WO2016/043246
PCT Pub. Date: Mar. 24, 2016

(65) Prior Publication Data

US 2017/0294740 A1 Oct. 12, 2017

(30) Foreign Application Priority Data

Sep. 19, 2014 (JP) ..... 2014-192005

(51) Int. Cl.
*H01R 13/622* (2006.01)
*H01R 24/38* (2011.01)

(52) U.S. Cl.
CPC ..... *H01R 13/622* (2013.01); *H01R 24/38* (2013.01)

(58) Field of Classification Search
CPC .. H01R 13/622; H01R 24/38; H01R 13/5202; H01R 13/5205; H01R 13/5219
See application file for complete search history.

(56) References Cited

U.S. PATENT DOCUMENTS 2,728,895 A * 12/1955 Quackenbush ..... F16L 37/1215 285/81
3,671,922 A * 6/1972 Zerlin ..... H01R 9/0518 439/352

(Continued)

FOREIGN PATENT DOCUMENTS

CN 101317305 A 12/2008
CN 102044817 A 5/2011

(Continued)

OTHER PUBLICATIONS

Jan. 17, 2017, JP communication issued for related JP application No. 2016-548926.

(Continued)

*Primary Examiner* — Oscar C Jimenez
*Assistant Examiner* — Edwin A. Leon
(74) *Attorney, Agent, or Firm* — Paratus Law Group, PLLC

(57) ABSTRACT

A connector includes a female-side connector and a male-side connector including an inner engagement portion and an outer engagement member or portion. The outer engagement member or portion has: an outer engagement member or portion body covering the female-side engagement portion from outside when the male-side connector is inserted into the female-side connector; and has a holder that, when the male-side connector is inserted into the female-side connector, covers the screw thread on the female-side engagement portion from outside, and fills a gap between the female-side engagement portion and the outer engagement member or portion body. The holder is disposed on an end portion side of the male-side connector from the inner engagement portion in a longitudinal direction of the male-side connector, and disposed so as to pinch the female-side engagement portion in cooperation with the inner engage- (Continued)

ment portion when the male-side connector is inserted into the female-side connector.

17 Claims, 13 Drawing Sheets

(56) References Cited

U.S. PATENT DOCUMENTS 4,806,116 A * 2/1989 Ackerman ..... H01R 24/542 439/304
4,941,846 A * 7/1990 Guimond ..... H01R 24/542 439/180
5,011,422 A * 4/1991 Yeh ..... H01R 24/44 439/133
5,439,386 A * 8/1995 Ellis ..... H01R 13/622 439/271
5,561,900 A 10/1996 Hosler
6,267,612 B1 * 7/2001 Arcykiewicz ..... H01R 13/6275 439/253
6,692,285 B2 * 2/2004 Islam ..... H02G 3/0691 439/352
8,915,752 B2 * 12/2014 Ariesen ..... H01R 9/0521 439/578
9,502,822 B1 * 11/2016 Huang ..... H01R 24/38
9,601,870 B1 * 3/2017 Ebisawa ..... H01R 13/635
2005/0048815 A1 * 3/2005 Daume ..... F16L 25/01 439/98
2005/0162238 A1 * 7/2005 Ho ..... H01R 24/42 333/185
2007/0105417 A1 * 5/2007 Camelio ..... H01R 13/6277 439/133
2008/0096405 A1 * 4/2008 Camelio ..... H01R 13/6277 439/133
2010/0035457 A1 * 2/2010 Holliday ..... H01R 13/622 439/345
2010/0233901 A1 9/2010 Wild et al.
2011/0053395 A1 * 3/2011 Leibfried, Jr. ..... H01R 13/6277 439/157
2011/0117776 A1 * 5/2011 Burris ..... H01R 9/0524 439/578
2011/0250789 A1 * 10/2011 Burris ..... H01R 13/5205 439/578
2013/0169056 A1 * 7/2013 Sherman ..... H01L 31/05 307/86
2013/0178096 A1 * 7/2013 Matzen ..... H01R 24/38 439/578
2014/0134877 A1 5/2014 Rosenberger
2015/0064952 A1 * 3/2015 Vaccaro ..... H01R 13/639 439/320
2015/0263449 A1 * 9/2015 Watkins ..... H01R 13/5219 439/277
2015/0364842 A1 * 12/2015 Matzen ..... H01R 24/38 439/578
2016/0036157 A1 * 2/2016 Endo ..... H01R 13/4365 439/587
2016/0204557 A1 * 7/2016 Kim ..... H01R 24/40 439/578
2017/0018893 A1 * 1/2017 Matzen ..... H01R 24/38
2017/0271827 A1 * 9/2017 Qin ..... H01R 24/40
2017/0279231 A1 * 9/2017 Purdy ..... H01R 24/40

FOREIGN PATENT DOCUMENTS

CN 103597671 A 2/2014
EP 0624933 A2 11/1994
JP 07-006830 1/1995
JP 11-026098 1/1999
JP 2000-082546 3/2000
JP 2004-079425 3/2004
JP 2005-327692 11/2005
JP 2009-517819 4/2009
JP 2009-123591 6/2009
WO WO 2007/062845 A1 6/2007

OTHER PUBLICATIONS

Dec. 1, 2015, International Search Report for related WO application No. PCT/JP2015/076368.
Dec. 1, 2015, Written Opinion of the International Searching Authority for related WO application No. PCT/JP2015/076368.
Feb. 5, 2018, Korean Office Action issued for related KR application No. 10-2017-7007427.
Aug. 3, 2018, Chinese Office Action issued for related CN Application No. 201580050401.0.
Mar. 27, 2018, European Search Report issued for related EP Application No. 15841350.0.

* cited by examiner

CONNECTOR

CROSS REFERENCE TO PRIOR APPLICATION

This application is a National Stage Patent Application of PCT International Patent Application No. PCT/JP2015/076368 (filed on Sep. 16, 2015) under 35 U.S.C. § 371, which claims priority to Japanese Patent Application No. 2014-192005 (filed on Sep. 19, 2014), which are all hereby incorporated by reference in their entirety.

TECHNICAL FIELD

The present invention relates to a connector, particularly, to a connector having improved operability between a plug (hereinafter, referred to as a "male-side connector") and a jack (hereinafter, referred to as a "female-side connector").

BACKGROUND ART

In the related art, as a commonly and widely known connector (for example, an SMA connector), there is a screw-type connector in which a male-side connector and a female-side connector are connected through screwing together. As illustrated in FIG. 13A, a connector 100 includes a male-side connector 101 and a female-side connector 110. A screw thread 111*a* is formed on an outer circumferential surface of an end portion 111 of the female-side connector 110, and a screw thread 102*a* corresponding to the screw thread 111*a* of the female-side connector 110 is formed on an inner circumferential surface of a coupling nut 102 of the male-side connector 101. The coupling nut 102 is rotatable and has a hexagon nut shape. The male-side connector 101 and the female-side connector 110 are connected to each other such that a pin 103 of the male-side connector 101 is inserted into a pin hole 112 of the female-side connector 110 during connection. Then, the coupling nut 102 is tightened up, thereby screwing the screw thread 102*a* and 111*a* of the male-side connector 101 and the female-side connector 110, respectively, and connecting both of the connectors 101 and 110. However, in the connector 100, it is necessary to perform screw tightening (screw loosening in a case of disconnecting) whenever connection is performed. Therefore, problems arise in that screw tightening work is complicated and work efficiency is degraded.

By comparison, in order to cope with the complicated screwing of the connector described above, a so-called push-on type connector (hereinafter, referred to as a "push-on connector") in which, the screw tightening work described above is omitted and engagement with the female-side connector is performed through one touch is known (see Patent Document 1). According to this document, a coupling inner circumferential portion positioned on an inner circumferential surface of an end portion of the female-side connector engages with, from inside, an elastic bulge portion on an elastic outer circumferential wall provided on a male-side connector. In this manner, the male-side connector and the female-side connector are fitted-connected to each other. As described above, the male-side connector and the female-side connector are connected by only the engagement of the elastic bulge portion described above.

Further, there is also another example in the related art in which a screw thread portion of a common female-side connector is subjected to machining (see Patent Document 2). According to the connector, the screw thread in the related art is not provided, but a protrusion is provided on an outer circumferential surface of the female-side connector, and the protrusion is caused to engage with a corresponding inclined long hole of a male-side connector. In this manner, bayonet locking-type attachment and detachment are performed.

CITATION LIST

Patent Documents

Patent Document 1: JP-A-2000-82546
Patent Document 2: JP-A-2009-123591

SUMMARY OF INVENTION

Problems to be Solved by Invention

However, in the example (push-on connector) of the related art disclosed in Patent Document 1 described above, when engagement with the female-side connector is performed, the connection is performed by only the engagement of the elastic bulge portion as described above, that is, by only locking of, as a main engagement portion in the connection of the male-side connector and the female-side connector, the elastic bulge portion as an inner spring of the male-side connector in the inner circumferential surface of the female-side connector. Above all, fitting accuracy is remarkably degraded, compared to the screw-type connector described above. A cause of degradation in the fitting accuracy is described with reference to FIG. 13B. FIG. 13B schematically illustrates a configuration specialized in the problem in the push-on connector described above. A connector 200 illustrated in the same figure includes a male-side connector 201 and a female-side connector 210, and a coupling nut 202 provided in the male-side connector 201 has a flush inner circumferential surface. In addition, the entire coupling nut 202 of the male-side connector 201 and a screw thread 211*a* formed on an end portion 211 of the female-side connector 210 are both formed of metal. In the connector 200 having such a configuration, in order to avoid rubbing between the metal members during the connection of the male-side connector 201 and the female-side connector 210, a gap L is formed between an inner circumferential surface 202*a* of the coupling nut 202 of the male-side connector 201 and an apex of the screw thread 211*a* of the female-side connector 210. As a result, rattling occurs during the connection of the connectors due to the gap L, and the fitting accuracy is degraded due to the gap. As described above, in the example in the related art disclosed in Patent Document 1, it is not possible to avoid rattling between both of the connectors 201 and 210 during the fitting-connecting of the male-side connector and the female-side connector, and the rattling results in insufficient safety in use.

In an example in the related art disclosed in Patent Document 2, since the common female-side connector (provided with the screw thread on the outer circumferential surface in the end portion thereof) in the related art needs to be subjected to the machining, problems arise in that a range of use is limited and the connector lacks general versatility.

Based on the description above, it is desirable to develop a connector in which it is possible to easily perform insertion and pullout and to improve fitting property while employing a configuration in which it is possible to use the widely common female-side connector as is.

The present invention is made in consideration of the problems described above, and an object thereof is to provide a connector in which it is possible to easily perform insertion and pullout and to improve fitting property while employing a configuration in which it is possible to use a widely common female-side connector as is.

Means for Solving the Problems

First, the present inventors have found a configuration in which, unlike the push-on connector described above, no gap is formed between the inner circumferential surface of the coupling of the male-side connector and the apex of the screw thread of the female-side connector, but a spacer is provided to fill a gap between a male-side connector and a female-side connector and an increase in a contact area between both connectors causes rattling between both of the connectors to be reduced and to improve fitting accuracy. In addition, without stopping with a solution by the spacer to the problem described above, second, the inventors have conceived that, when the male-side connector and the female-side connector engage with each other, it is possible to select an insertion and pullout method (fitting accuracy) when both of a configuration, in which the spacer holds down the screw thread of the female-side connector from outside and pinches the screw thread portion of the female-side connector from the inner circumferential surface, and a configuration of fastening with a screw are provided together. In other words, with both of the configurations according to the first and second aspects above, it is not only possible to improve the fitting accuracy, but also it is possible to select an insertion and pullout method (fitting accuracy) in one connector and it is possible to select application suitable for a use. In addition, in the entire content described above, since there is no need to modify the female-side connector, it is possible to employ the configuration in which it is possible to use the widely common female-side connector as is, and it is possible to improve general versatility.

In other words, in order to achieve the object, according to the present invention, there is provided a connector including: a female-side connector that has a cylindrical shape and includes a female-side engagement portion having an outer circumferential surface on which a screw thread is formed; and a male-side connector that includes an inner engagement portion which locks an inner circumferential surface of the female-side engagement portion from inside during insertion, and an outer engagement member or an outer engagement portion that covers the female-side engagement portion from outside during the insertion. The outer engagement member or the outer engagement portion has an outer engagement member body or an outer engagement portion body that covers the female-side engagement portion from the outside when the male-side connector is inserted into the female-side connector, and a holder that is provided integrally with, or separately from and inside the outer engagement member body or the outer engagement portion body, and that, when the male-side connector is inserted into the female-side connector, covers the screw thread on the female-side engagement portion from the outside fills a gap between the female-side engagement portion and the outer engagement member body or the outer engagement portion body, and holds down the screw thread of the female-side connector from the outside. The holder is disposed on an end portion side of the male-side connector from the inner engagement portion in a longitudinal direction of the male-side connector, and is disposed so as to pinch the female-side engagement portion in cooperation with the inner engagement portion when the male-side connector is inserted into the female-side connector.

In such a configuration described above, the male-side connector includes the outer engagement member or the outer engagement portion (hereinafter, referred to as an "outer engagement portion (member)") that covers, from the outside, the female-side engagement portion on which the screw thread of the female-side connector is formed, during the insertion into the female-side connector. In addition, the outer engagement portion (member) covers the screw thread of the female-side engagement portion from the outside during the insertion of the connector, and the holder that fills the gap between the female-side engagement portion and the outer engagement member body or the outer engagement portion body (hereinafter, referred to as an "outer engagement portion (member) body") is provided integrally with or separately from the outside engagement portion (member) body. Therefore, when the male-side connector is inserted into the female-side connector, the holder fills the gap between the outer engagement portion (member) body and the female-side engagement portion. In this manner, even in a state in which only the insertion is performed, the contact area of the female-side engagement portion between the male-side connector and the female-side connector is relatively increased, compared to the push-on connector described above. In this manner, it is possible to reduce the rattling between both of the connectors, and to improve the fitting accuracy. Hence, unlike the screw-type connector in the related art, it is not only possible to save time and effort to rotate the couplings and to screw both whenever insertion is performed, in order to increase the fitting accuracy, but also it is possible to reduce the rattling when the insertion and pullout is performed on the so-called push-on connector in the related art. Then, not only a fitting property improves, but also operability improves.

In addition, the holder is disposed on the outside of the female-side engagement portion and is configured to pinch the female-side engagement portion in cooperation with the inner engagement portion of the male-side connector. Therefore, the holder comes into contact with the female-side engagement portion on the outer side of the female-side engagement portion from the inner engagement portion, thereby, making it possible to come into contact with the female-side engagement portion with a larger contact area, making it possible to reduce the rattling between both of the connectors, and making it possible to more reduce the rattling with the female-side connector pinched between the holder and the inner engagement portion, compared to a case where only the inner engagement portion is disposed-formed in the male-side connector. In this manner, the fitting property further improves.

Further, since the male-side connector is provided with the outer engagement portion having the holder, which is disposed on the end portion side of the male-side connector than the inner engagement portion in the longitudinal direction, the outer engagement portion is disposed in a shifted state in the longitudinal direction of the connector from an position at which both engagement portions overlap in the longitudinal direction of the male-side connector in a relationship with the inner engagement portion. In this manner, since it is possible to further reduce an angle of the rattling that occurs during the insertion of the connector, it is possible to further reduce the rattling during the insertion of the connector and the fitting property of both connectors further improves.

In addition, in the connector of the present invention, the holder has a ring shape or a cylindrical shape with a predetermined thickness, has an increasable diameter of the inner circumference, and has a portion that is brought into contact with the female-side engagement portion from the outside. According to such a configuration, even when a tolerance is formed with respect to an outer diameter of the female-side engagement portion, it is possible to perform the insertion and pullout in a state of allowing the tolerance. Therefore, flexibility of the fitting improves.

Here, it is desirable that the holder is formed to have a cylindrical shape or a C-ring shape in which notches are formed. According to such a configuration, it is possible to reliably realize such effects described above, and the flexibility of the fitting improves.

The male-side connector may be configured to further include a cover portion that is slidable in the male-side connector in the longitudinal direction thereof and is rotatable in a circumferential direction thereof. The cover portion may include a male-side engagement portion on which a screw thread is formed at a position corresponding to the female-side engagement portion. The screw thread of the cover portion may be screwed with the screw thread of the female-side engagement portion of the female-side connector in a case where the cover portion moves to the side of the female-side connector. The screw thread of the cover portion may not interfere with the screw thread of the female-side engagement portion of the female-side connector in a case where the cover portion moves to a side opposite to the side of the female-side connector. According to such a configuration, when the male-side connector is inserted, the holder moves to the side opposite to the female-side connector, and, in this state, the insertion is simply performed as described above, and joining of the cover portion is performed with respect to the female-side connector. In this manner, first, it is possible to easily insert or pull out both of the connectors in a state of improving the fitting accuracy. In addition, in a case where the fitting accuracy of the connector needs to be reliably increased, the cover portion may be caused to move to the side of the female-side connector and the screw thread formed on the cover portion and the engagement portion (screw thread) of the female-side connector may be tightened up with each other in a state in which both of the connectors are connected to each other. In this manner, compared to a type of connector in the related art in which the screw is completely tightened up, it is not only possible to easily perform the insertion and pullout, but also it is possible to more stably ensure the same fitting accuracy. According to such a configuration, it is possible to change the fitting accuracy as suitable for a use.

BRIEF DESCRIPTION OF DRAWINGS

FIG. 1A is a view illustrating a difference between contact areas on an inner circumferential surface and an outer circumferential surface of a female-side engagement portion, FIG. 1B is a view illustrating a difference between rotation angles due to rattling of the female-side engagement portion, and FIG. 1C is a view illustrating a difference between reactive forces occurring due to the rattling of the female-side engagement portion.

FIG. 2A is a view illustrating both of a male-side connector and a female-side connector in a state in which both connectors abut on each other before fitting, FIG. 2B is a view illustrating a way of fitting of the male-side connector and the female-side connector, which is represented by two dashed lines, and FIG. 2C is a view illustrating a state in which the male-side connector is fitted into the female-side connector.

FIG. 3A illustrates an O-ring-shaped holder of the first embodiment, FIG. 3B illustrates a C-ring-shaped holder of a second embodiment, and FIG. 3C is illustrates a cylindrical holder of a third embodiment in which notches are formed.

FIG. 4A is a front view of the holder, FIG. 4B illustrates a right side view of the holder, FIG. 4C is a rear view of the holder, and FIG. 4D is a perspective view of the holder.

FIG. 5A is a view illustrating both of a male-side connector and a female-side connector in a state in which both connectors abut on each other before fitting, FIG. 5B is a view illustrating a way of fitting of the male-side connector and the female-side connector, which is represented by two dashed lines, FIG. 5C is a view illustrating a state in which the male-side connector is fitted into the female-side connector, and 5D is a view illustrating a state in which a cover portion is caused to further slide and is screwed from the fitted state in FIG. 5C.

FIG. 7A is a diagram schematically illustrating a main configuration of the connector, and FIG. 7B is a graph illustrating a test result thereof.

FIG. 8A is a diagram schematically illustrating a main configuration of the connector, and FIG. 8B is a graph illustrating a test result thereof.

FIG. 9A is a diagram schematically illustrating a main configuration of the connector, and FIG. 9B is a graph illustrating a test result thereof.

FIG. 10A is a diagram schematically illustrating a main configuration of the connector, and FIG. 10B is a graph illustrating a test result thereof.

FIG. 11A is a diagram schematically illustrating a main configuration of the connector, and FIG. 11B is a graph illustrating a test result thereof.

FIG. 12A is a diagram schematically illustrating a test method thereof, and FIG. 12B is a graph illustrating a test result thereof.

FIG. 13A illustrates a partially sectional view for illustrating a common screw-type connector, and FIG. 13B illustrates a partially sectional view for illustrating a problem of a push-on connector in the related technology.

EMBODIMENTS FOR CARRYING OUT THE INVENTION

Figure 1A:
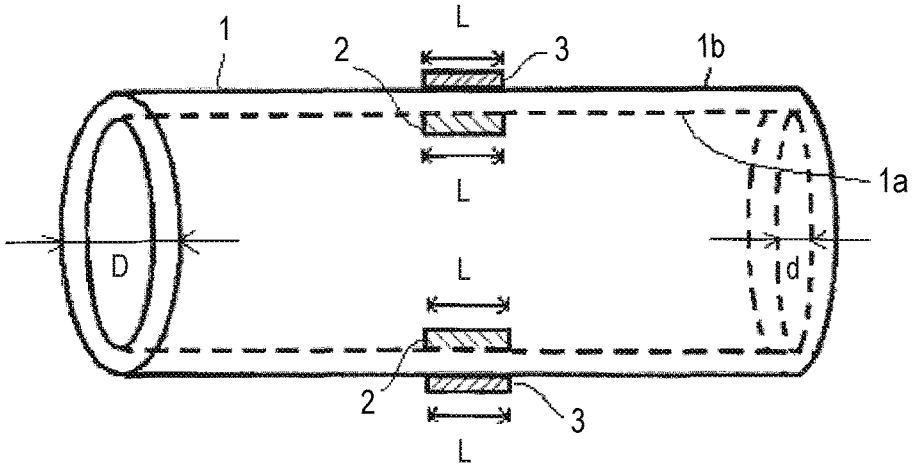
FIGS. 1A to 1C show views illustrating a principle (main point) of the present invention.
Figure 1B:
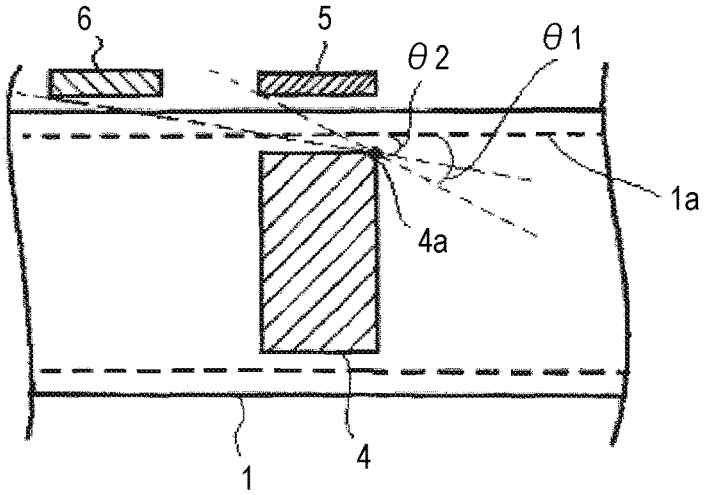
Figure 1C:
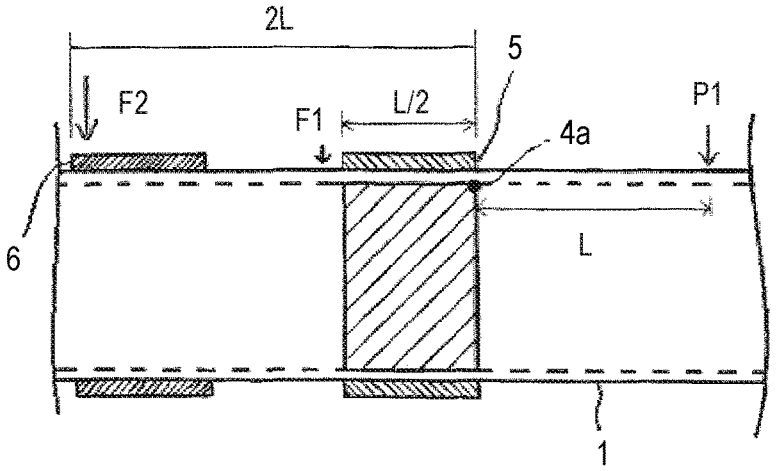

First, for easy understanding of the present invention, a principle (main point) of the present invention is described in brief. FIGS. 1A to 1C show views for illustrating the principle (main point) of the present invention. Note that the same configuration is described by being assigned with the same reference signs in FIGS. 1A to 1C.

(1) Configuration of Holding Down from Outside

According to the present invention, first, as a premise, a female-side engagement portion (screw thread) of a female-side connector is held down from the outside by an outer engagement portion (member) of a male-side connector. In this manner, compared to a push-on connector (type of supporting only an inner circumferential surface of the female-side engagement portion with only an elastic bulge portion (inner spring) provided in the male-side connector) in the related art described above, it is possible to more increase an area in which the male-side engagement portion is in contact with the female-side engagement portion. FIGS. 1A to 1C show partially enlarged views of a female-side engagement portion 1 of the female-side connector, specifically, as shown in FIG. 1A, there are disposed an inner-circumference contact member 2 and an outer-circumference contact member 3 that extend along a circumferential surface of an inner circumferential surface 1*a* and an outer circumferential surface 1*b* of the female-side engagement portion 1 (with an inner diameter of d and an outer diameter of D) having a cylindrical shape when schematically viewed, respectively, and both have a length of L in a longitudinal direction. In this case, of areas in which the inner-circumference contact member 2 and the outer-circumference contact member 3 are in contact with the female-side engagement portion 1, the contact area of the outer-circumference contact member 3 is larger (contact area of the inner-circumference contact member 2=d*π*L and contact area of the outer-circumference contact member 3=D*π*L). As described above, the female-side engagement portion (screw thread) is held down by the outer engagement portion (member) from the outside, and the contact area is larger than that in the related art. In this manner, it is possible to have an inhibitive force stronger than the rattling of the female-side engagement portion, and it is possible to reduce the rattling during insertion of the male-side connector and the female-side connector and to improve fitting accuracy.

(2) Shift of Outer Engagement Portion

In the invention of the present application, as a premise, positions of an inner engagement portion and a holder that pinch the female-side engagement portion are shifted from each other in the longitudinal direction of the male-side connector. In this manner, the rattling of the connector is reduced, compared to a case where the inner engagement portion and the holder are disposed at positions which rather overlap in the longitudinal direction. Specifically, as illustrated in FIG. 1B, in a relationship with an inner engagement member 4 disposed in an inner circumferential portion (inside a hole) of the schematically illustrated female-side engagement portion 1, that a first outer engagement member 5 disposed at the same position in the longitudinal direction as the inner engagement member and a second outer engagement member 6 disposed at a position shifted in the longitudinal direction from the inner engagement direction in the longitudinal direction (horizontal direction in the same figure) of the female-side engagement portion 1 is assumed. In the same figure, for easy understanding, a state in which the first and second outer engagement members 5 and 6 are present together in one figure is illustrated. In this state, when rattling (clockwise movement in the same figure) occurs in the female-side engagement portion 1, an inner circumferential surface 1*a* of the female-side engagement portion 1 comes into contact with an angular portion 4*a* of the inner engagement member 4 and rotates with the angular portion 4*a* as a fulcrum. With the rotation, a rotation angle for coming into contact with the first or second outer engagement member 5 or 6 is θ1 in a case of the first outer engagement member 5, and is θ2 in a case of the second outer engagement member 6. Then, as illustrated in the same figure, a relationship of θ1>θ2 is established. As described above, the positions of the inner engagement portion and the outer engagement portion that pinch the female-side engagement portion are shifted from each other in the longitudinal direction of the connector. In this manner, it is possible to more reduce the rotation angle due to the rattling of the female-side engagement portion, particularly, the rattling of the female-side connector, and it is possible to reduce the rattling during the insertion of the male-sider connector and the female-side connector and to improve fitting accuracy.

In addition, in details described above, a case where the inner engagement member and the outer engagement member are separated by a predetermined distance on the inner circumferential surface 1*a* or the outer circumferential surface 1*b* of the female-side connector, respectively is described. By comparison, even in a case where the inner engagement member 4 and the first outer engagement member 5 or the second outer engagement member 6 are in contact with the female-side engagement portion 1, as illustrated in FIG. 1C, a reactive force F1 is generated in the case of the first outer engagement member 5 and a reactive force F2 is generated in the case of the second outer engagement member 6 with respect to the rattling (clockwise movement in the same figure and with strength represented by a force P1 in the same figure) of the female-side engagement portion 1 with the angular portion 4*a* of the inner engagement member 4 as the fulcrum. The reactive forces are clearly known to decrease as a distance from the fulcrum (angular portion 4*a*) increases. As illustrated in the same figure, this means that a relational expression of P1*L1=F*L/2=F2*2L is established in a case where a distance from a point of a force to the fulcrum is L, a distance from the fulcrum to a point on which the first outer engagement member 5 acts is L/2, and a distance from the fulcrum to a point on which the second outer engagement member 6 acts is 2L. In other words, as in the present invention, the outer engagement portion (member) is disposed at the position shifted from the inner engagement portion, it is possible to more decrease the reactive force due to the rattling of the male-side connector and the female-side connector and it is possible to improve the fitting accuracy of both of the connectors.

(3) Holding of Screw Thread

Further, in the present invention, the female-side connector is not subjected to machining unlike the connector of the example in the related art disclosed in Patent Document 2 described above, the female-side engagement portion (screw thread) of the common female-side connector is not subjected to any machining, and the screw thread is held down from the outside. In this manner, it is possible to use-employ the widely common female-side connector, and thus it is possible to improve general versatility. In addition, as will be described below, the holder provided in the male-side connector of the present invention has an increasable diameter of an inner circumference. Therefore, even in a case where the inner circumference of the holder is smaller than an outer circumference of the apex of the screw thread of the female-side connector, the holder comes into contact with the screw thread of the female-side connector during the insertion and pullout. In this manner, an inner circumferential surface of the holder expands, the inner circumferential surface of the holder expands along the outer circumference of the apex of the screw thread of the female-side connector, and it is possible to efficiently hold the screw thread by holding down the screw thread of the female-side connector from the outside due to the elasticity. In addition, even in a case where a tolerance of the screw thread is present, the inner diameter of the holder changes depending on a size corresponding to the tolerance, and it is possible to use the holder with respect to the widely common female-side connector.

As a configuration in which the principle (gist) of the present invention described above is realized, connectors according to the following first to fourth embodiments are configured. The inventions of the claims are not limited to the following embodiments, and an entire combination of features described in the embodiments is not necessary to establish the present invention. Hereinafter, the embodiments will be described with reference to the figures. Note that a connector of the following embodiments is used for connecting or the like of a device main body of a measurement device with a cable, and the connector is applied to microwaves (a frequency band is DC to 26.5 GHz) depending on a measuring instrument that used a high frequency. In the following description, only the connector of the present invention is illustrated, and a device, a cable, or the like to which the connector of the present invention is applied is not illustrated in the figures.

Figure 2A:
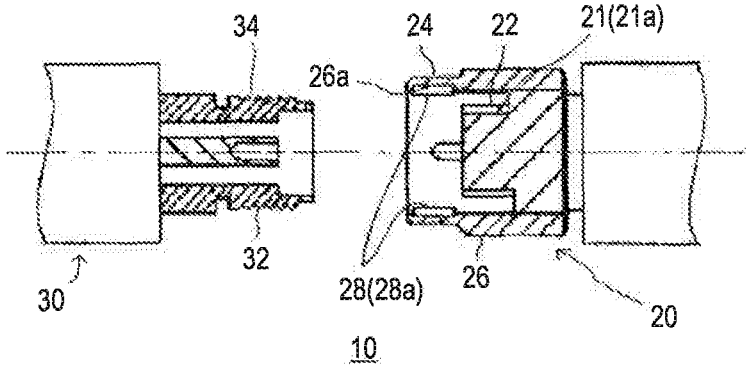
FIGS. 2A to 2C show sectional views illustrating a configuration of a connector and a connection operation of a first embodiment of the present invention.
Figure 2B:
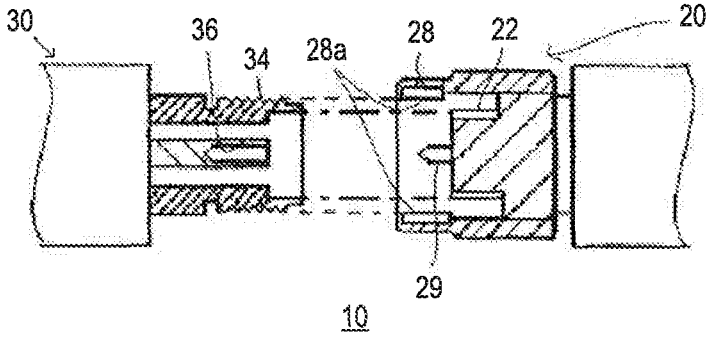
Figure 2C:
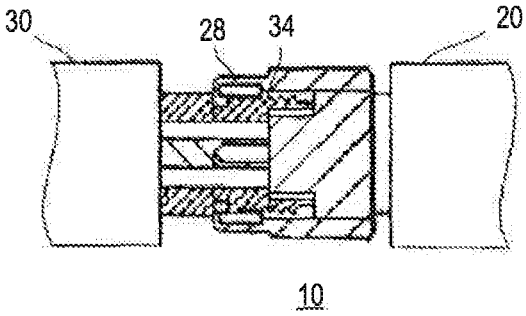

FIGS. 2A to 2C show sectional views schematically illustrating common parts in configurations of connectors of the first to third embodiments of the present invention, FIG. 2A is a view illustrating a state in which both of the male-side connector and the female-side connector abut on each other before the fitting, FIG. 2B is a view illustrating a way of fitting (method of fastening) of the male-side connector and the female-side connector, which is represented by a dashed line and a dashed-dotted line, and FIG. 2C is a view illustrating a state in which the male-side connector is fitted (fastened) into the female-side connector.

As illustrated in FIGS. 2A to 2C, a connector 10 of the embodiment includes a male-side connector 20 and a female-side connector 30. The entire female-side connector 30 has a substantially cylindrical shape and is provided a female-side engagement portion 32 on which a screw thread 34 is formed around an outer circumference of an overlap portion thereof during engagement with the male-side connector 20. The male-side connector 20 is provided with an elastic bulge member (inner engagement member) 22 having an inner spring shape for locking an inner circumferential surface of the female-side engagement portion 32 from the inside during the insertion of the connector 10, and an outer engagement member 24 that covers the female-side engagement portion 32 from the outside during the insertion of the male-side connector 20 into the female-side connector 30 (hereinafter, simply referred to as "during connector insertion"). The elastic bulge member (inner engagement member) 22 is disposed on an inner engagement portion 21*a* provided on the outer circumferential surface of a shaft 21 of the male-side connector 20, and engages with the inner circumferential surface of the female-side engagement portion 32 of the female-side connector 30. The outer engagement member 24 of the male-side connector 20 is provided with a coupling (outer engagement member body) 26 that covers the female-side engagement portion 32 from the outside during the connector insertion, and a holder (not hatched, the same in the following figures) 28 that is provided separately from and inside the coupling 26, covers the screw thread 34 on the female-side engagement portion 32 from the outside during the connector insertion, and fills the gap between the coupling 26 and the female-side engagement portion 32. In the embodiment, the coupling 26 is formed of metal, and is provided with a holder engaging groove 26*a* formed on the inner circumferential surface of an end portion (left end in the figure) thereof, along the circumferential surface. The holder 28 is formed of a resin (polyacetal (POM) in the embodiment) having wear resistance, heat resistance, and slippage properties, and is formed to have an O-ring shape with a predetermined thickness, has an inner diameter that is equal to an outer diameter of the apex of the screw thread 34 of the female-side engagement portion 32, and is fitted into the holder engaging groove 26*a* formed in the coupling 26. In addition, the holder 28 is configured to pinch the female-side engagement portion 32 in cooperation with the elastic bulge member 22 during the connector insertion, and to be disposed on one end portion side (left end side in the same figure) from the elastic bulge member (inner engagement member) 22 in the longitudinal direction of the male-side connector 20.

Figure 3A:
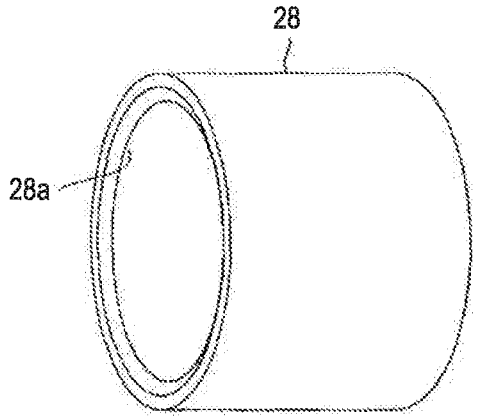
FIGS. 3A to 3C show perspective views schematically illustrating a holder of the male-side connector in the connector of the embodiment of the present invention.

FIG. 3A is a perspective view schematically illustrating the holder 28 of the male-side connector 20 in the connector of the embodiment. As illustrated in FIG. 3A, the holder 28 is configured to have the O-ring shape, to have an increasable diameter of the inner circumference to the extent that the holder has elasticity because the holder is formed of the resin, and to have a portion (inner-circumference contact surface) 28*a* that is brought into contact with the female-side engagement portion 32 from the outside. In addition, inner circumferential surfaces of both end portions of the holder 28 are chamfered along an inner hole.

Next, a connection operation and action and effects of the operation of the connector 10 of the embodiment are described with reference to FIGS. 2A to 2C. As illustrated in FIG. 2A, in the connection of the connector 10 of the embodiment, the female-side connector 30 and the male-side connector 20 face each other, the female-side connector 30 is pushed in into the male-side connector 20 as illustrated in FIG. 2C while a terminal hole 36 of the female-side connector 30 and a position of a terminal pin 29 of the male-side connector 20 are aligned along the dashed line and the dashed-dotted line illustrated in FIG. 2B, and the terminal pin 29 of the male-side connector 20 penetrates into the terminal hole 36 of the female-side connector 30 such that the electrical connection of the terminal pin is performed.

As described above, when the male-side connector 20 and the female-side connector 30 are fitted together, the following effects are achieved. In other words, the connector 10 of the embodiment includes the outer engagement member 24 that covers the female-side engagement portion 32 from the outside during the insertion, and the holder 28 that is separately provided from the outer engagement member 24 inside the member, covers the screw thread 34 of the female-side engagement portion 32 from the outside during the connector insertion, and fills a gap between the outer engagement member body 26 and the female-side engagement portion 32. Therefore, when the male-side connector 20 is inserted into the female-side connector 30, the holder 28 fills the gap between the outer engagement member body 26 and the female-side engagement portion 32 and an inner-circumference contact surface 28*a* of the holder 28 comes into contact with the apex of the screw thread 34 of the female-side engagement portion 32. In this manner, even in a state in which only the insertion is performed, the contact area of the male-side connector 20 and the female-side connector 30 is relatively increased, compared to that of the push-on connector described above. In this manner, it is possible to reduce the rattling between both of the connectors 20 and 30, and to improve the fitting accuracy. As described above, according to the connector 10 of the embodiment, it is possible to simply connect the male-side connector 20 and the female-side connector 30 by one touch in a state of having higher fitting accuracy, compared to the push-on connector in the related art. In this manner, it is not only possible to save time and effort to connect the common connector in the related art in which the coupling is caused to rotate every time the connection is performed such that both connectors are screwed, but also it is possible to reduce the rattling when the insertion and pullout is performed, and thus the fitting properties improve. In addition, the operability improves.

In addition, the holder 28 is disposed on the outside of the female-side engagement portion 32 and is configured to pinch the female-side engagement portion 32 in a cooperation relationship with the elastic bulge member (inner engagement member) 22. Therefore, the holder comes into contact with the female-side engagement portion 32 on the outer side of the female-side engagement portion 32 from the elastic bulge member (inner engagement portion) 22, thereby, making it possible to come into contact with the female-side engagement portion 32 with a larger contact area, making it possible to reduce the rattling between both of the connectors, and making it possible to more reduce the rattling of both of the connectors. Further, the holder pinches the female-side connector 30 in cooperation with the elastic bulge member (inner engagement portion) 22, and thereby it is possible to reduce the rattling, compared to a case of only the elastic bulge member (inner engagement portion) 22. In this manner, the fitting property improves.

In addition, since the holder 28 of the outer engagement member 24 is disposed on the end portion side (left end side in the same figure) from the elastic bulge member (inner engagement portion) 22 in the longitudinal direction of the male-side connector 20, the outer engagement member 24 is disposed in a shifted state in the longitudinal direction of the connector 10, in a relationship with the inner engagement member 22, thereby it is possible to further reduce the rattling of both of the connectors 20 and 30, and the fitting property further improves.

Further, in the connector 10 of the present invention, since the holder 28 has the O-ring shape and is formed of polyacetal (POM) as the resin, or a cylindrical shape with a predetermined thickness, the holder has predetermined elasticity. Thus, the diameter of the inner circumference is increasable, and the holder has the inner-circumference contact surface 28*a* that is brought into contact with the screw thread 34 of the female-side engagement portion 32 from the outside. In this manner, even when a tolerance is formed in the outer diameter of the apex of the screw thread 34 of the female-side engagement portion 32, it is possible to perform the insertion and pullout in a state of allowing the tolerance. Therefore, flexibility of the fitting improves.

In addition, in the connector 10 of the embodiment, since the holder 28 is formed of non-metal, and further is formed of polyacetal (POM) as the resin having the wear resistance, heat resistance, and slippage property, and it is possible to reliably realize the effects described above, and the flexibility of the fitting further improves. On the other hand, the female-side engagement portion 32 that is covered by the holder 28 is formed of metal, similar to the common female-side connector. In a case where that the holder 28 is formed of metal is assumed, both engage with each other, and thereby there is a concern that the screw thread 34 of the female-side engagement portion 32 will be cut, broken, or damaged. In this respect, the holder 28 is formed of the resin, and thereby the hardness thereof is lower than the female-side engagement portion 32 formed of metal. Therefore, there is no concern that the female-side engagement portion 32 will be damaged, and thereby it is possible to improve quality stability.

Further, similar to the common female-side connector in the related art, the female-side connector 30 of the embodiment is provided with the screw thread 34 formed on the outer circumferential surface thereof, thus, the female-side connector is not subjected to machining unlike the connector of the example in the related art disclosed in Patent Document 2, the female-side engagement portion (screw thread) of the common female-side connector is not subjected to any machining, and the female-side engagement portion (screw thread) of the common female-side connector does not need to be subjected to any machining, and it is possible to use-employ the widely common female-side connector, and thus it is possible to improve general versatility.

Figure 3B:
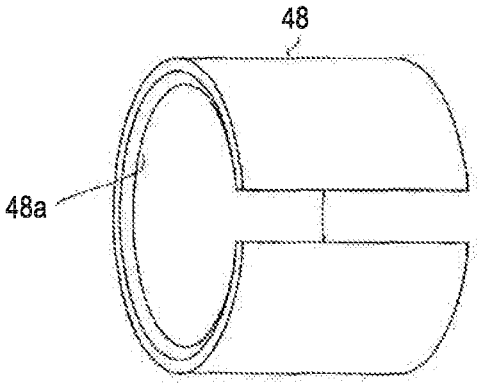

Next, the second embodiment will be described with reference to FIG. 3A. In the embodiment, differences between the configurations of the holder are described, the other configurations are the same as those in the first embodiment, and the same reference signs used in the description are assigned to the first embodiment. FIG. 3B is a perspective view schematically illustrating a holder 48 of the male-side connector 20 in the connector of the second embodiment of the present invention. As illustrated in FIG. 3B, the holder 48 of the second embodiment is formed to have a C-ring shape. In addition, similar to the holder 28 having the O-ring shape in the first embodiment, the holder 48 is formed of polyacetal (POM) as the resin. According to the embodiment, since the holder 48 has the C-ring shape and has a more increasable diameter of the inner circumference, compared to the holder 28 having the O-ring shape of the first embodiment. In addition, similar to the holder 28 having the O-ring shape of the first embodiment, the holder 48 has an inner-circumference contact surface 48*a* that is brought into contact with the screw thread 34 of the female-side engagement portion 32 from the outside. In this manner, even when the tolerance is formed with respect to the outer diameter of the female-side engagement portion 32, it is possible to perform the insertion and pullout in a state of allowing the tolerance. Therefore, flexibility of the fitting improves. In other words, since the diameter of the inner circumference of the C-ring increases, it is easy to allow the tolerance of the outer diameter of the screw thread 34 of the female-side engagement portion 32, it is possible to use-employ the more common female-side connector in the related art, and the C-ring has a merit compared to the O-ring of the first embodiment.

Figure 3C:
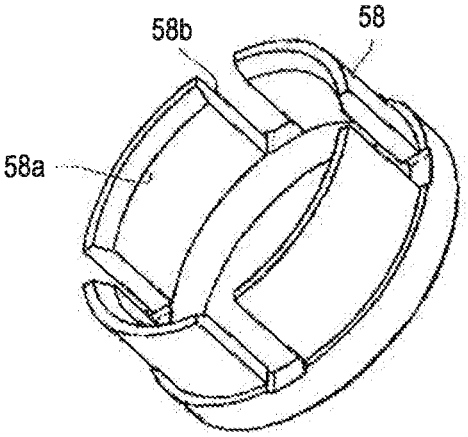

Next, the third embodiment will be described with reference to FIG. 3C. Also in the embodiment, differences between the configurations of the holder are described, and the other configurations are the same as those in the first embodiment. FIG. 3C is a perspective view schematically illustrating a holder 58 of the male-side connector in the connector of the third embodiment of the present invention. As illustrated in FIG. 3C, in the connector of the third embodiment of the present invention, the holder 58 is characterized to be formed to have a cylindrical shape in which a total of four notches (slits) 58*b* are formed at equal intervals along the circumferential surface only in one direction (only on the end portion side of the male-side connector). In addition, similar to the holder 28 having the O-ring shape in the first embodiment, the holder 58 is formed of polyacetal (POM) as the resin. According to the embodiment, since the holder 58 is formed to have the "cylindrical shape in which the notches 58*b* are formed", the diameter of the inner circumference is more increasable, compared to the holder 28 having the O-ring shape of the first embodiment. In addition, similar to the holder 28 having the O-ring shape of the first embodiment, the holder 58 has an inner-circumference contact surface 58*a* that is brought into contact with the female-side engagement portion 32 from the outside. In this manner, even when the tolerance is formed with respect to the outer diameter of the screw thread 34 of the female-side engagement portion 32, it is possible to perform the insertion and pullout in a state of allowing the tolerance. Therefore, flexibility of the fitting improves. In other words, since the notches (slits) 58*b* is widened, it is easy to allow the tolerance of the outer diameter of the apex of the screw thread 34 of the female-side connector 30, and the notches have a merit compared to the O-ring of the first embodiment. In addition, since the holder 58 has the cylindrical shape as a whole, and the notches (slits) 58*b* are not formed in an entire length direction, the holder 58 has a merit that the center shaft is not shifted during the connector insertion, compared to the C-ring type holder 48 of the second embodiment, and it is possible to improve work stability during the connector insertion.

Figure 4A:
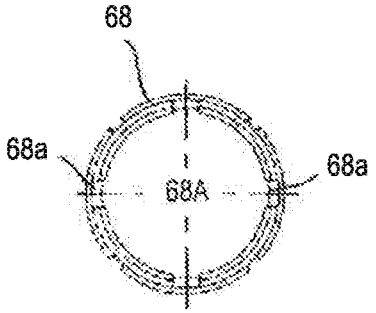
FIGS. 4A to 4D show views illustrating a configuration of a holder of a fourth embodiment of the present invention.
Figure 4B:
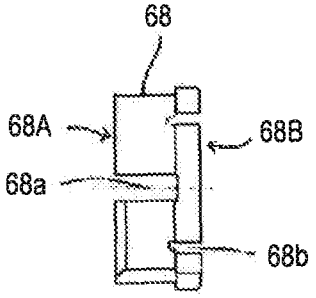
Figure 4C:
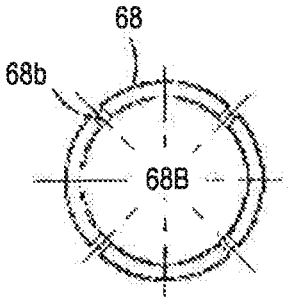
Figure 4D:
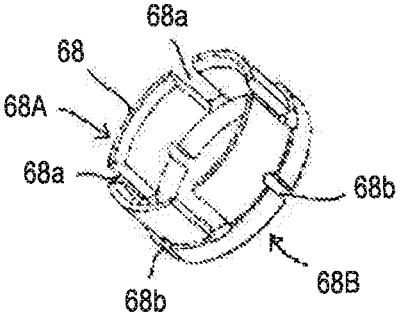
Figure 5A:
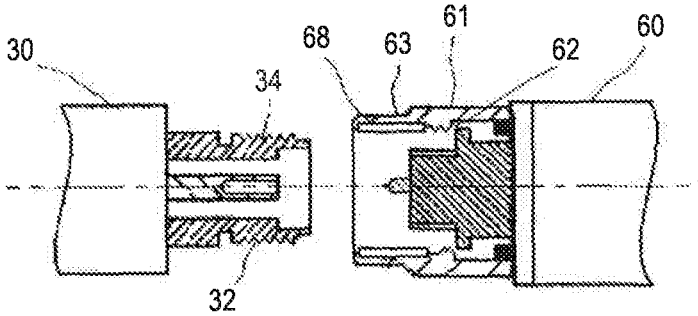
FIGS. 5A to 5D show sectional views illustrating a configuration of a connector and a connection operation of the fourth embodiment of the present invention.
Figure 5B:
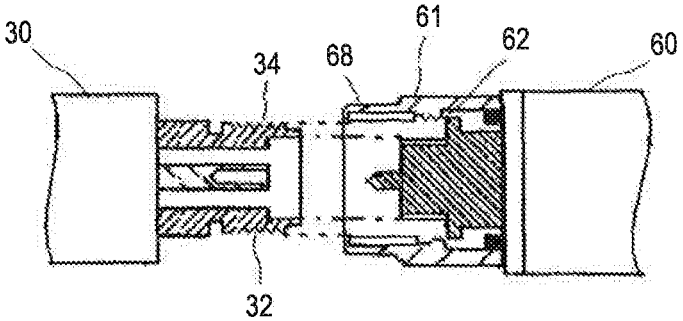
Figure 5C:
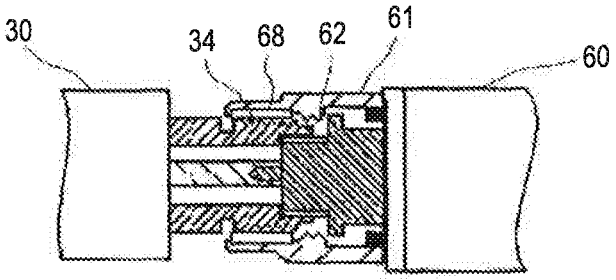
Figure 5D:
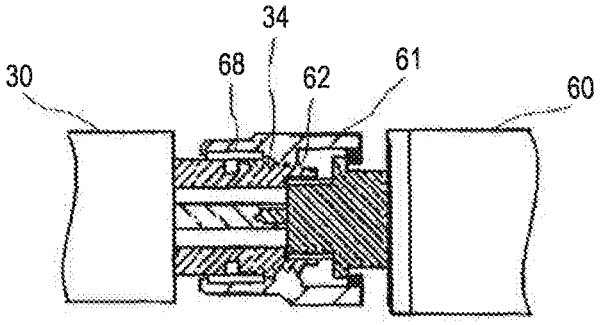

Next, the connector of the fourth embodiment of the present invention is described with reference to FIGS. 4A to 4D and 5A to 5D. FIGS. 4A to 4D show views illustrating a configuration of a holder of the fourth embodiment of the present invention, FIG. 4A is a front view of the holder, FIG. 4B illustrates a right side view of the holder, FIG. 4C is a rear view of the holder, and FIG. 4D is a perspective view of the holder. FIGS. 5A to 5D show sectional views illustrating a configuration of a connector and a connection operation of the embodiment, FIG. 5A is a view illustrating both of the male-side connector and the female-side connector in a state in which both connectors abut on each other before fitting, FIG. 5B is a view illustrating a way of fitting of the male-side connector and the female-side connector, which is represented by two dashed lines, FIG. 5C is a view illustrating a state in which the male-side connector is fitted into the female-side connector, and FIG. 5D is a view illustrating a state in which a cover portion is caused to further slide and is screwed from the fitted state in FIG. 5C. A basic configuration of the connector of the embodiment is the same as the configuration of the connector of the first embodiment illustrated in FIGS. 2A, 2B, and 2C, and thus the same reference signs are assigned to the same portions, and the description thereof is omitted. As illustrated in FIGS. 4 and 5, the embodiment is different from the first to third embodiments described above in that the coupling (cover portion) 61 has a configuration in which it is possible for the coupling to slide and a shape of a holder 68 is different. As illustrated in FIGS. 4A to 4C, in a male-side connector 60 of the embodiment, the holder 68 is formed to have a cylindrical shape in which the notches (slits) are formed. In addition, as illustrated in FIGS. 4B and 4D, notches 68*a* and 68*b* are formed from one end side 68A and the other end side 68B of the holder 68, respectively, the notches 68*a* from the one end side and the notches 68*b* from the other end side are not formed along the same line, and the notches 68*a* and 68*b* are configured to partially overlap each other in the longitudinal direction.

As described above, regarding the notches 68*a* and 68*b*, the notches 68*a* from the one end side and the notches 68*b* from the other end side are not formed along the same line, and the notches are configured to partially overlap in the longitudinal direction. Therefore, it is possible to more increase the diameter of the inner circumference, compared to the holder 28 having the O-ring shape of the first embodiment and the holder 48 having the C-ring shape of the second embodiment. In this manner, even when the tolerance is formed with respect to the outer diameter of the screw thread 34 of the female-side engagement portion 32, it is possible to perform the insertion and pullout in a state of allowing the tolerance. Therefore, flexibility of the fitting improves. In other words, since the notches (slits) 68*a* and 68*b* are widened, it is easy to allow the tolerance of the outer diameter of the screw thread 34 of the female-side engagement portion 32, and the notches have a merit compared to the holder 28 of the O-ring shape of the first embodiment. Since the holder 68 has the cylindrical shape as a whole, and the notches are not formed in the entire length direction, the holder has a merit that the center shaft is not shifted during the insertion, compared the C-ring type holder 48 of the second embodiment, and it is possible to improve work stability during the connector insertion. According to such a configuration, it is possible to reliably realize such effects described above, and the flexibility of the fitting improves. In addition, the notches 68*a* and 68*b* are formed from both ends of the holder 68, respectively, it is possible to easily insert and pull out the female-side engagement portion of the female-side connector by dispersing a load according to the holder by the increase in the diameter of the inner circumferential surface, when the female-side engagement portion (screw thread) of the female-side connector is inserted and is pulled out, compared to a configuration of the notches only in one direction as illustrated, as the holder 58 described above.

In the connector of the embodiment, as illustrated in FIG. 5A, the male-side connector 60 is configured to be further provided with a cover portion (coupling) 61 that is slidable in the male-side connector in the longitudinal direction thereof. The cover portion 61 is provided with a male-side engagement portion 63 on which a screw thread 62 is formed at a position corresponding to the female-side engagement portion 32. The screw thread 62 of the cover portion 61 is able to be screwed with the screw thread 34 of the female-side engagement portion 32 in a case where the cover portion 61 moves to the side of the female-side connector 30. The screw thread 62 of the cover portion 61 does not interfere with the screw thread 34 of the female-side engagement portion 32 of the female-side connector 30 in a case where the cover portion 61 moves to a side opposite to the side of the female-side connector 30.

Specifically, the cover portion 61 has a cylindrical shape, and is provided with a stopper 64 on the inner circumferential surface in an end portion (end portion on the right side in FIGS. 5A to 5D) on the side opposite to the end portion side of the male-side connector 60, and is configured to be able to reciprocate (slide) in the longitudinal direction between a position (position in FIG. 5A, hereinafter, referred to as an "initial position") on the side opposite to the end portion side of the male-side connector 60 and a position (position in FIG. 5D, hereinafter, referred to as an "movement position") on the end portion side of the male-side connector 60, in a relationship with a locking portion 65*a* formed on the outer circumferential surface of a shaft 65 of the male-side connector 60. In addition, in a case where the cover portion 61 is disposed at the initial position, the screw thread 62 formed on the inner circumferential surface of the cover portion 61 is formed at a position at which the screw thread 62 does not interfere with the screw thread 34 of the female-side connector 30 when the insertion of the male-side connector 60 and the female-side connector 30 is performed, and the screw thread is formed at a position at which the screw thread 62 can be screwed with the screw thread 34 of the female-side connector 30 at the movement position.

Figure 13A:
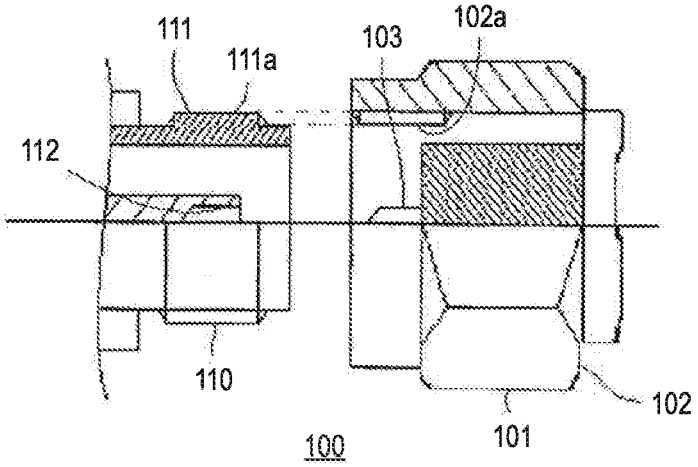
FIGS. 13A and 13B show views illustrating a connector in the related technology.
Figure 13B:
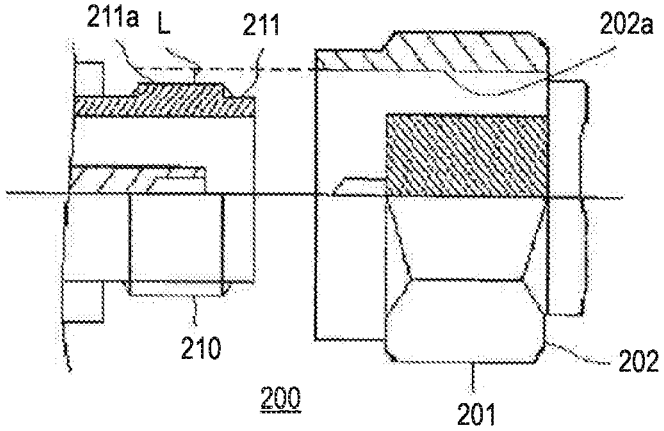

According to the embodiment, as illustrated in FIG. 5A, when the connector is inserted, the cover portion 61 is set at the initial position by moving to the cable side (not illustrated) with respect to the female-side connector 30. In this state, the male-side connector 60 and the female-side connector 30 illustrated in FIG. 5A approach each other, are simply inserted, and are joined from a separate state of both connectors 60 and 30 along the dashed line and the dashed-dotted line illustrated in FIG. 5B (refer to FIG. 5C). In this manner, first, similar to the first to third embodiments, it is possible to easily insert and to pull out the male-side connector 60 and the female-side connector 30. In addition, in a case where higher fitting accuracy of both connectors 60 and 30 needs to be achieved, the cover portion 61 is caused to move in a direction of the female-side connector 30 in the connected state, and the screw thread 62 formed on the cover portion itself and an engagement portion 32 (screw thread 34) of the female-side connector 30 are tightened up with each other at the movement position (refer to FIG. 5D). In a diagram of the entire configuration of the connector illustrated in FIG. 5C, although not illustrated in the male-side connector 60, the outer circumferential surface of the male-side connector 60 may be configured to have a hexagonal shape, similar to the example in the related art illustrated in FIGS. 13A and 13B described above. In an alternative example, the hexagonal portion can be tightened by using a jig such as a hexagonal wrench. In this manner, compared to a screw type connector in the related art in which the screw is completely tightened up, it is not only possible to easily perform the insertion and pullout, but also it is possible to more stably ensure the same fitting accuracy as that in the related art. Further, since the holder 68 of the male-side connector 60 improves the fitting accuracy of the connectors 60 and 30, it is possible to improve the fitting accuracy, similar to the screw-type connector in the related art. As described above, it is possible to change the fitting accuracy depending on the presence or absence of the screw tightening of the cover portion 61.

Figure 6:
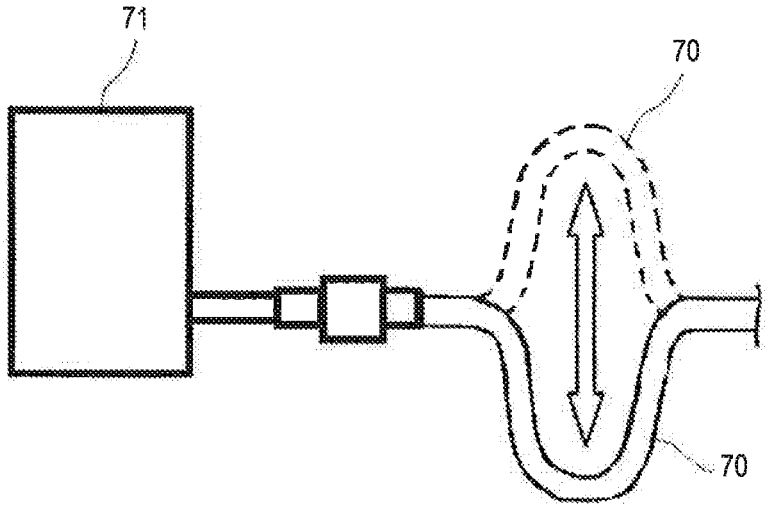
FIG. 6 is a diagram illustrating a test method in order to verify fitting effects of the connector of the embodiments of the present invention.

FIG. 6 is a diagram illustrating a test method for verifying fitting effects of the connector of the embodiments of the present invention. FIGS. 7A and 7B to 11A and 11B show diagrams illustrating test results for verifying the fitting effect of the connector of the embodiment of the present invention, FIGS. 7A, 8A, 9A, 10A, 11A and 12A are diagrams schematically illustrating a main configuration of the connector and FIGS. 7B, 8B, 9B, 10B, 11B and 12B are graphs showing test results. The prevent inventors causes a coaxial cable 70, to which the male-side connector is applied, to move vertically in a state in which the measuring instrument vector network analyzer (VNA) 71 is connected to the coaxial cable, as illustrated in FIG. 6, in order to check the fitting effects of the connector of the embodiment described above, and the inventors measured a change in the insertion loss.

FIGS. 7A and 7B to 11A and 11B illustrate actual measurements of behavior of the acquired insertion loss due to the presence or absence of the inner engagement portion and the outer engagement portion provided in the male-side connector, and FIGS. 7A, 8A, 9A, 10A, 11A and 12A are diagrams schematically configurations and FIGS. 7B, 8B, 9B, 10B, 11B and 12B are data of the insertion loss obtained in the configuration thereof. Although not illustrated, the female-side connector used to measure an insertion loss employs any common female-side connector which is provided with the screw thread formed on the outer circumferential surface of the female-side engagement portion.

Figure 7A:
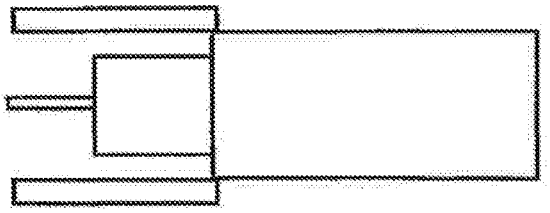
FIGS. 7A and 7B show diagrams of a test conducted in order to verify fitting effects of a sample connector as Comparative Example 1 that includes a male-side connector which is not provided with a holder, a screw thread, and an inner engagement member (inner spring)
Figure 7B:
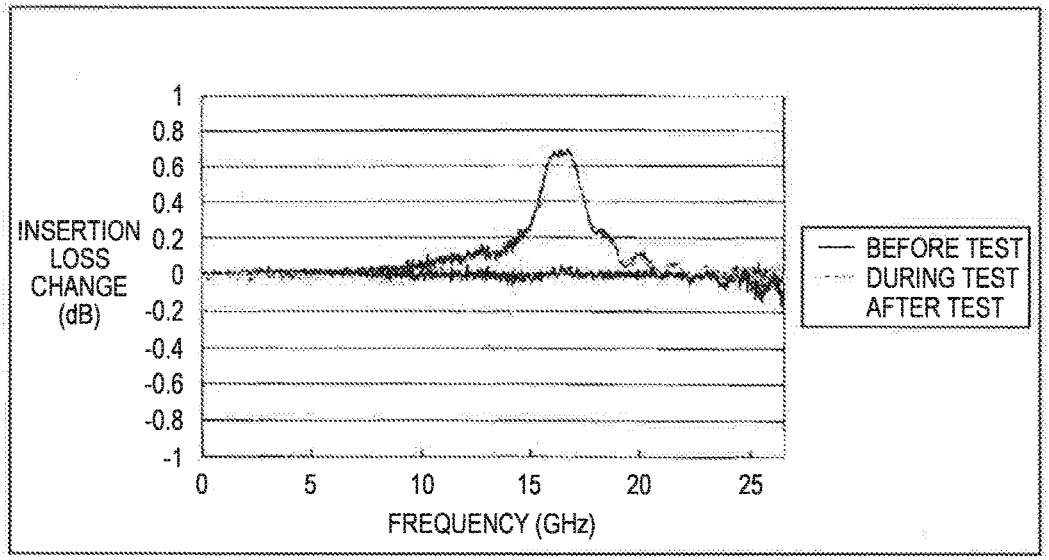

FIG. 7A is a diagram illustrating a test for verifying the fitting effect of a type of sample without the male-side connector (not including the holder and the screw thread, but including the inner engagement member (inner spring)) as Comparative Example 1, in which the screw thread is not formed on the inner circumferential surface of the coupling of the male-side connector and without the male-side connector, and the inner engagement member (elastic bulge member) is not employed in the male-side connector, that is, a configuration in which the elastic bulge member (inner spring) is further removed from the push-on type connector in the related art. As illustrated in FIG. 7B, before the test, the insertion loss has a value that approximates to around 0, and there is substantially no change, and, during the test, the insertion loss significantly increases in a band of frequency 10 to 20 GHz. In addition, even after the test, the insertion loss significantly increases vertically in the band of frequency 10 to 20 GHz.

Figure 8A:
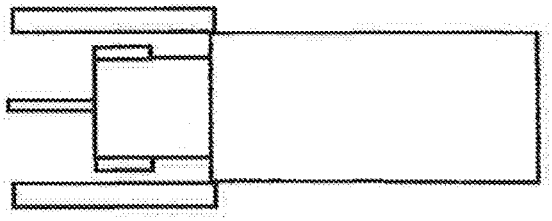
FIGS. 8A and 8B show diagrams of a test conducted in order to verify fitting effects of a sample connector as Example 1 that includes a male-side connector which is not provided with a holder and a screw thread, but is provided with an inner engagement member (inner spring)
Figure 8B:
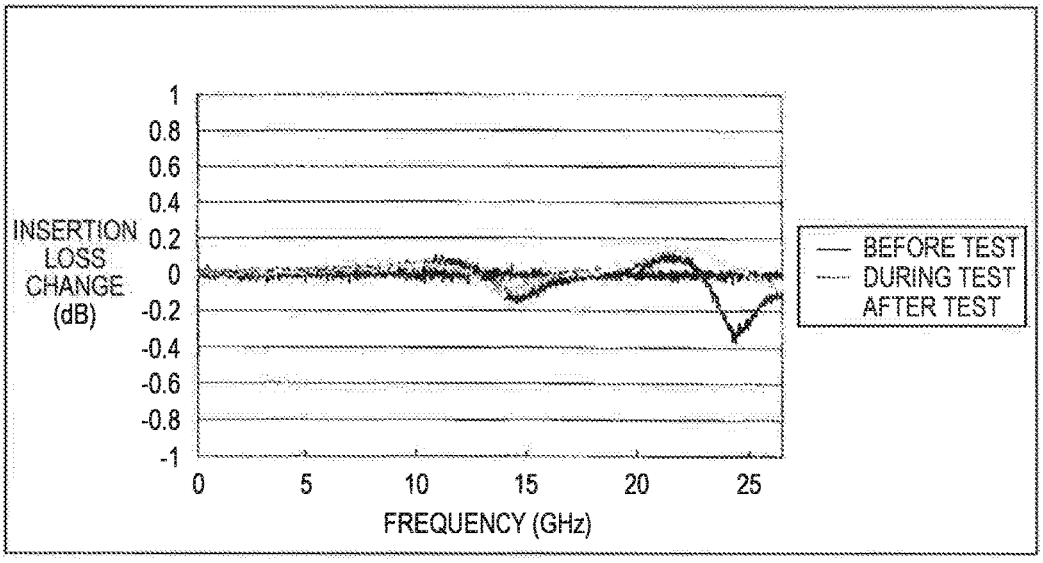

FIG. 8A is a diagram illustrating a test conducted for verifying fitting effects of a sample as Example 1 that includes a male-side connector which is not provided with the holder and the screw thread, but is provided with the inner engagement member (inner spring), that is, a connector that includes the male-side connector 20 which is provided with the inner engagement member 22 as in the push-on type connector in the related art. In Example 1, as illustrated in FIG. 8B, before the test, the insertion loss has a value that approximates to around 0, and there is substantially no change, and, during the test, the insertion loss slightly increases vertically in the band of frequency 10 to 20 GHz, particularly, the insertion loss increases downward in a band of frequency 22 GHz. In addition, even after the test, the insertion loss slightly vertically changes in the band of frequency 10 to 20 GHz, particularly, the insertion loss has an upward peak in the band of frequency 22 GHz. However, even with the maximum vertical fluctuation width, the insertion loss is smaller than 0.2 in the band of 22 GHz after the test, particularly, the insertion loss is smaller than −0.4 in the band of 24 GHz during the test. As described above, a sample including the male-side connector that is not provided with the screw thread, but is provided with the inner engagement member (inner spring), that is, a connector including the male-side connector that is provided with the inner engagement member in association with the present invention, achieves the fitting effect better than that in Comparative Example 1.

Figure 9A:
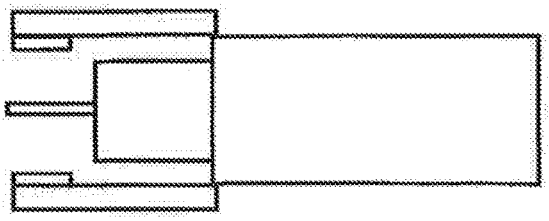
FIGS. 9A and 9B show diagrams of a test conducted in order to verify fitting effects of a sample connector as Example 2 that includes a male-side connector which is provided with a holder, but is not provided with a screw thread and an inner engagement member (inner spring)
Figure 9B:
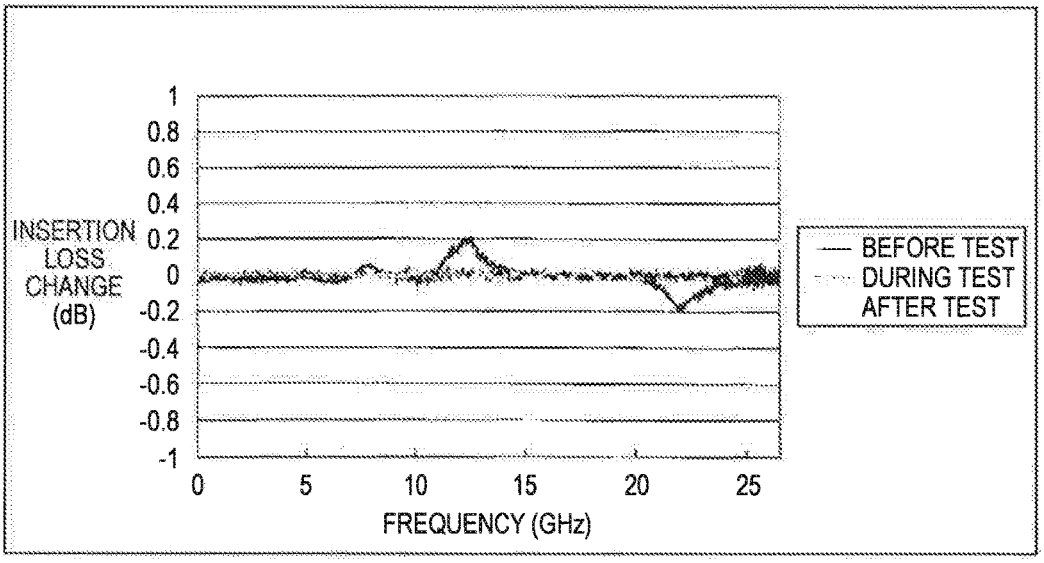

FIG. 9A is a diagram illustrating a test conducted for verifying fitting effects of a sample as Example 2 that includes the male-side connector which is provided with the holder (formed of POM and having the O-ring shape), but is not provided with the screw thread and the inner engagement member (inner spring), that is, a connector that includes the male-side connector provided with the holder in association with the present invention. In Example 2, as illustrated in FIG. 9B, before the test, the insertion loss has a value that approximates to around 0, and there is substantially no change, and, during the test, the insertion loss slightly changes with the upward peak in the band of frequency 12.5 GHz, particularly, the insertion loss increases downward to −0.2 in a band of frequency 22 GHz. In addition, even after the test, the insertion loss somewhat increases in the band of frequency 23 GHz or higher, however the insertion loss does not exceed 0.2. Even with the maximum vertical fluctuation width, the insertion loss is smaller than 0.2 in the band of 12 GHz during after the test, particularly, the insertion loss is smaller than −0.2 in the band of 22 GHz during the test. As described above, the sample including the male-side connector that is provided the holder, but is not provided with the inner engagement member (inner spring), that is, a connector including the male-side connector that is provided with the holder in association with the present invention, achieves the fitting effect much better than that in Comparative Example 1 and Example 1.

Figure 10A:
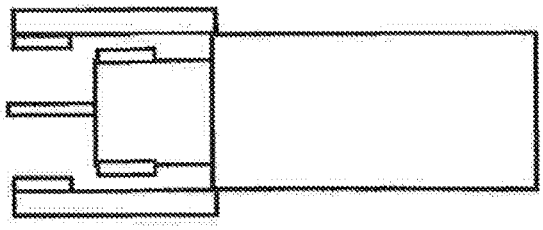
FIGS. 10A and 10B show diagrams of a test conducted in order to verify fitting effects of a sample connector as Example 3 that includes a male-side connector which is not provided with a screw thread, but is provided with a holder and an inner engagement member (inner spring)
Figure 10B:
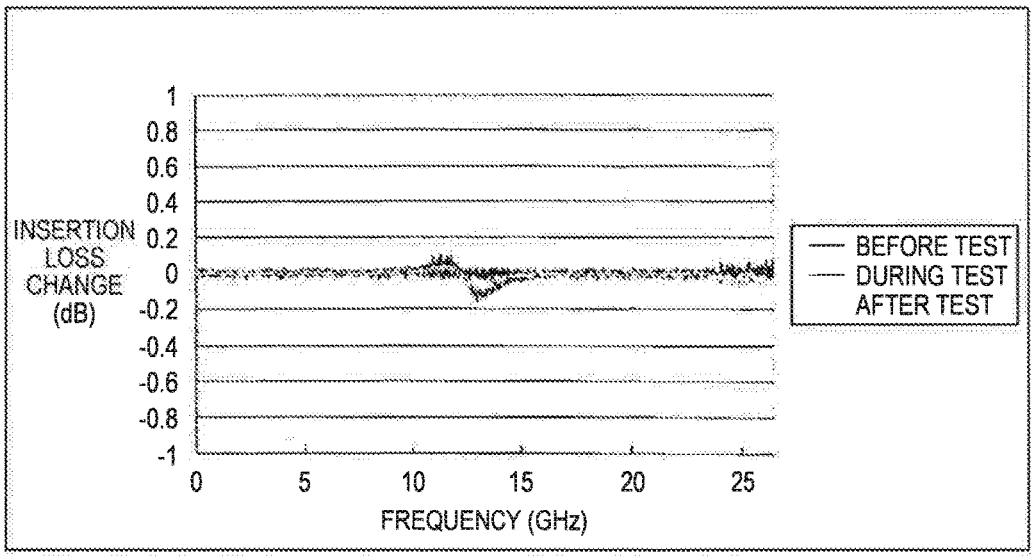

FIG. 10A is a diagram illustrating a test conducted for verifying fitting effects of a sample as Example 3 that includes a male-side connector which is provided with the holder (formed of POM and having the O-ring shape), is not provided with the screw thread, but is provided with the inner engagement member (inner spring), that is, a connector that includes the male-side connector which is provided with both of the holder and the inner engagement member in association with the present invention. As illustrated in FIG. 10B, before the test, the insertion loss has a value that approximates to around 0, and there is substantially no change, and, during and after the test, the insertion loss only slightly changes vertically in the band of frequency 10 to 15 GHz, particularly, the insertion loss is about ±0.1 during and after the test even with the maximum vertical fluctuation width. As described above, the sample including the male-side connector that is provided the holder (resin fixing member) and the inner engagement member (inner spring), that is, a connector including the male-side connector 20 that is provided with both of the holder 28 and the inner engagement member 22 in association with the present invention, achieves the fitting effect much better than that in Examples 1 and 2.

Figure 11A:
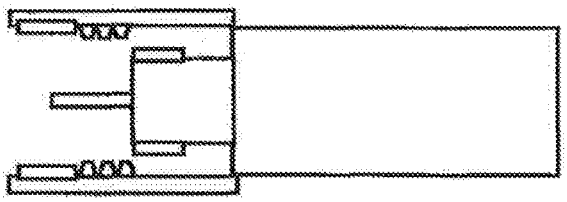
FIGS. 11A and 11B show diagrams of a test conducted in order to verify fitting effects of a sample connector as Example 4 that includes a male-side connector which is provided with a holder, a screw thread, and an inner engagement member (inner spring)
Figure 11B:
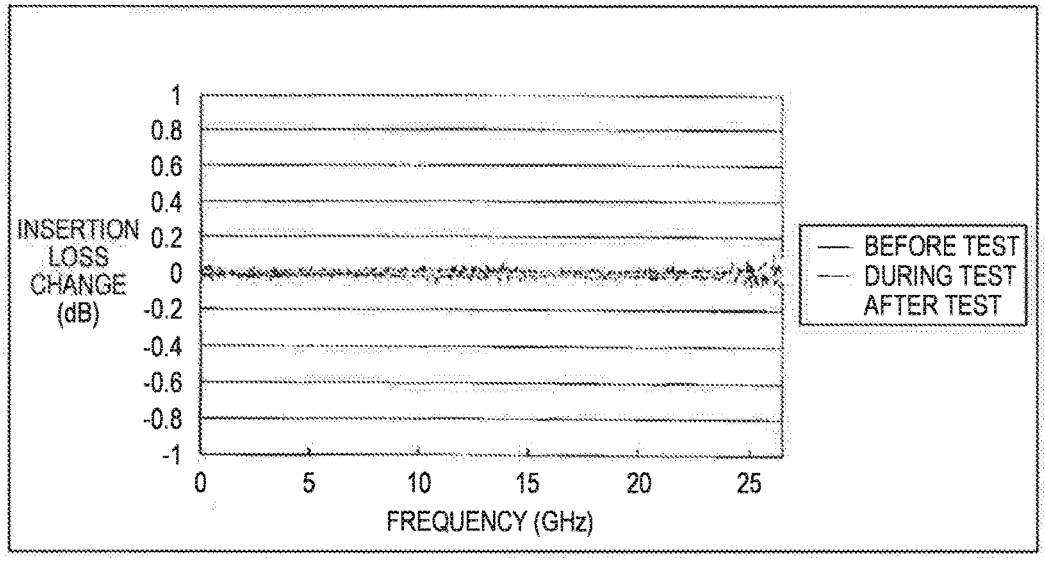

FIG. 11A shows diagrams of a test conducted for verifying fitting effects of the male-side connector 60 according to the fourth embodiment described above, as Example 4, in which the coupling 61 is caused to move to the movement position, that is, a sample that includes a male-side connector which is provided with a holder, a screw thread, and an inner engagement member (inner spring). As illustrated in FIG. 11B, before the test, during the test, and after the test, the insertion loss has a value that approximates to around 0, and there is substantially no change. As described above, the coupling (provided with the screw thread formed on the inner circumferential surface) of the male-side connector is provided, is tightened with the female-side connector, and thereby the type of connector in which that is screwed with the screw thread of the female-side connector achieves high fitting effects.

Figure 12A:
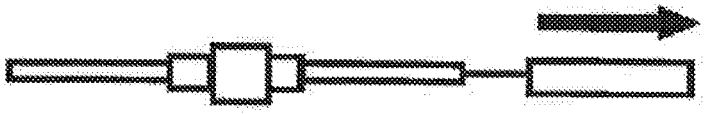
FIGS. 12A and 12B show diagrams illustrating a test conducted in order to verify easiness of use of the connectors of the embodiments of the present invention.
Figure 12B:
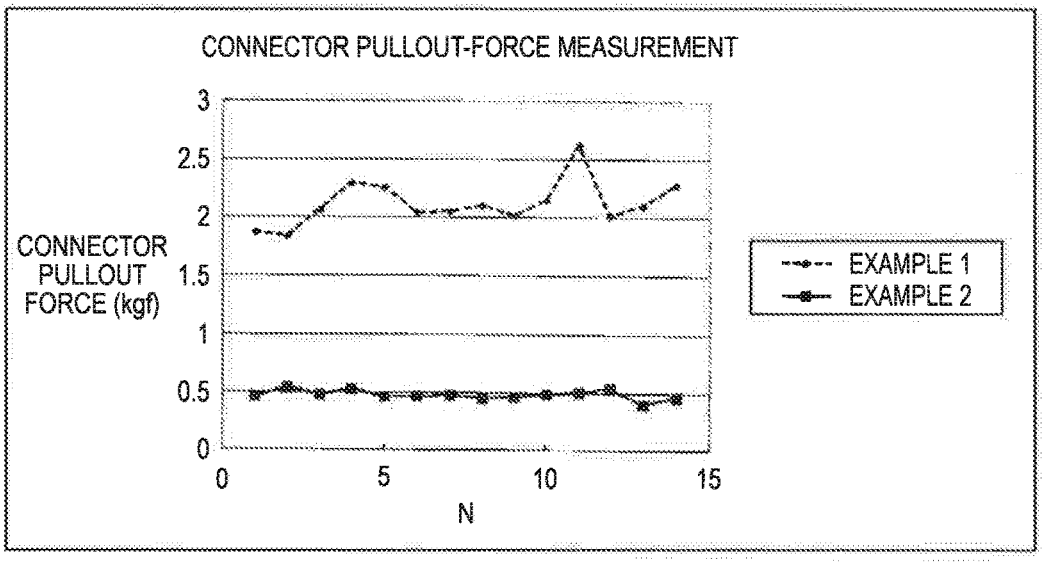

FIGS. 12A and 12B show diagrams illustrating a test conducted for verifying easiness (easiness of insertion and pullout) of a use of the connectors of the embodiments of the present invention, FIG. 12A is a diagram schematically illustrating a test method thereof, and FIG. 12B is a graph illustrating a test result thereof. In order to verify the easiness of the use of the connector of the embodiments described above, the prevent inventors measures a change in a force (kgf) required to pull out the connector with respect to the number of times of pullout N with the coaxial cable connected to the male-side connector pulled by a tensile tester as illustrated in FIG. 12A. In other words, even in the tests in FIGS. 7A and 7B to 11A and 11B, Example 4, that is, the coupling (provided with the screw thread formed on the inner circumferential surface) of the male-side connector is provided, is fastened with the female-side connector, and thereby the type of connector that is screwed with the screw thread of the female-side connector achieves high fitting effects; however, the connector of the example in the related art has complicated screw tightening, and thus a fundamental problem arises in that the work efficiency is degraded.

As illustrated in FIG. 12B, the upper graph in the dashed line, as Example 1, represents test results of a sample that includes the male-side connector which is not provided with the screw thread and is provided with the inner engagement member (spring), that is, a connector including the male-side connector provided with the inner engagement member in association with the present invention, and the lower graph in a solid line, as Example 2, represents test results of a sample that includes the male-side connector which is provided with the holder (resin fixing member), but is not provided with the inner engagement member (spring), that is, a connector including the male-side connector 20 provided with the holder 28 in association with the present invention.

As illustrated in FIG. 12B, in Example 2, the number of times of pullout is from one time to 14 times, and the force required to pull the connector does not substantially change at 0.5 (kgf). As described above, as Example 2, a sample that includes the male-side connector 20 which is provided with the holder (resin fixing member), buy is not provided with the inner engagement member (spring), that is, a connector including the male-side connector 20 provided with the holder 28 in association with the present invention, does not need a large force to pull out the connector. Therefore, for example, even in a case where the connector is inserted and is pulled out several times, it is possible to verify the easiness in a use is good, in a test process of a measurement device or the like in a manufacturing site.

The holder 28, 48, 58, or 68 are formed of polyacetal (POM) as the resin; however, the holder may be formed of a material having the wear resistance, heat resistance, and slippage properties, such as polyether ether ketone (PEEK), poly-tetrafluoroethylene, or the like, and thereby it is needless to say that the more great effects of the inventions of the application are achieved; however, the holder is not limited to the materials and may be formed of a resin or nonmetal other than the materials. In addition, in the embodiment described above, connection of the connector to a measuring instrument, the coaxial cable, and the like is described; however, it is needless to say that the connection may be applied to connection between an electrical device other than the measuring instrument and the cable, or connection between cables. In addition, the holder is formed to have a ring shape or a cylindrical shape with the predetermined thickness; however, this means that the holder has the predetermined thickness and length and a shape corresponding to the female-side engagement portion, and it is needless to say that the holder is not limited to the shapes described above. Further, the holder of the embodiment is configured to be separated from the outer engagement member; however, the outer engagement member and the holder may be formed of the resin having the properties described above and may be configured to be integral with each other. In addition, the holder of the embodiment is formed of the resin; however, the material is not limited thereto as long as the holder functions as the spacer that fills the gap between the outer engagement portion (member) body of the male-side connector and the screw thread of the female-side engagement portion of the female-side connector, it is needless to say that the holder may be formed of metal, ceramic, or the like, and examples of metal include phosphor bronze or beryllium copper.

In addition, in the first to third embodiments, the holder and the inner engagement portion are configured in a state of being completely shifted from each other in the longitudinal direction, and, in the fourth embodiment, the holder and the inner engagement portion are configured in a state of having an overlapping portion with each other in the longitudinal direction; however, at least both may be shifted in the longitudinal direction.

INDUSTRIAL APPLICABILITY

The present invention can be widely applied regardless of size•material•use, as long as the connector of the invention electrically connects the male side and the female side. In addition, the technical idea of the present invention is construed to be also extensible to a joint or the like that is mechanically connected in addition to the electrical connection between the male side and the female side.

REFERENCE SIGNS LIST

1: female-side engagement portion
1*a*: inner circumferential surface
1*b*: outer circumferential surface
2: inner-circumference contact member
3: outer-circumference contact member
d: inner diameter
D: outer diameter
L: length
4: inner engagement member
4*a*: angular portion
5: first outer engagement member
6: second outer engagement member
θ1, θ2: rotation angle
P1: force
F1, F2: reactive force
10: connector
20: male-side connector
21: shaft
21*a*: inner engagement portion
22: elastic bulge member (inner engagement member)
24: outer engagement member
26: coupling (outer engagement member body)
26*a*: holder engaging groove
28: holder
28*a*: portion brought into contact from outside (inner-circumference contact surface)
29: terminal pin
30: female-side connector
32: female-side engagement portion
34: screw thread
36: terminal hole
48: holder
48*a*: inner-circumference contact surface
58: holder
58*a* inner-circumference contact surface
58*b*: notch (slit)
60: male-side connector
61: coupling (cover portion)
62: screw thread
63: male-side engagement portion
64: stopper
65: shaft
65*a*: locking portion
68: holder
68A: one end side
68B: the other end side
68*a*, 68*b*: notch
70: coaxial cable
71: measuring instrument (VNA)

The invention claimed is:

1. A connector fitting body comprising:

a female-side connector that includes a terminal and a female-side engagement portion positioned outside of the terminal, the female-side engagement portion having a cylindrical shape and having an outer circumferential surface on an outer side of the cylindrical shape on which a screw thread is formed, and having an inner circumferential surface on an inner side of the cylindrical shape that faces the terminal; and a male-side connector that includes an electrically connecting terminal pin which is inserted into the terminal of the female-side connector during insertion of the male-side connector into the female-side connector, an inner engagement portion which locks the inner circumferential surface of the female-side engagement portion from inside during the insertion, and an outer engagement portion that has a cylindrical shape that covers the female-side engagement portion from outside during the insertion, wherein the outer engagement portion has an outer engagement portion body that covers the female-side engagement portion from the outside when the male-side connector is inserted into the female-side connector, and a holder that is provided separately from and inside the outer engagement portion body and that, when the male-side connector is inserted into the female-side connector, covers the screw thread on the female-side engagement portion from the outside in a direction perpendicular to a longitudinal direction of the connector fitting body, fills a gap between the female-side engagement portion and the outer engagement portion body, and holds down the screw thread of the female-side engagement portion from the outside in the direction perpendicular to the longitudinal direction, wherein the holder is disposed on an end portion side of the male-side connector from the inner engagement portion in a longitudinal direction of the male-side connector, and is disposed so as to pinch the female-side engagement portion in cooperation with the inner engagement portion when the male-side connector is inserted into the female-side connector, wherein the outer engagement portion body of the male-side connector is configured to be slidable in the longitudinal direction of the male-side connector and rotatable in a circumferential direction of the male-side connector, the outer engagement portion body of the male-side connector includes an inner circumferential surface of the outer engagement portion, the inner circumferential surface having a first region on which a screw thread is formed and a second region positioned between the first region and an end portion of the male-side connector and on which the holder is provided, and wherein the connector fitting body is configured to have a plurality of electrical connection states of the terminal of the female-side connector and the electrically connecting terminal pin of the male-side connector, the plurality of electrical connection states including:

a first electrical connection state in which the terminal of the female-side connector is electrically connected with the electrically connecting terminal pin of the male-side connector in a case where the outer engagement portion body slides into a side of the female-side connector and the screw thread formed on the outer engagement portion is screwed with the screw thread of the female-side engagement portion; and a second electrical connection state in which the terminal of the female-side connector is electrically connected with the electrically connecting terminal pin of the male-side connector in case where the outer engagement portion body slides into an opposite side to the side of the female-side connector and the screw thread formed on the outer engagement portion is not screwed with the screw thread of the female-side engagement portion and the screw thread of the female-side engagement portion is held down by the holder.

2. The connector fitting body according to claim 1, wherein the holder has a ring shape or a cylindrical shape with a thickness, has an increasable diameter of the inner circumference, and has a portion that is brought into contact with the female-side engagement portion from outside.

3. The connector fitting body according to claim 1, wherein the holder is formed to have a cylindrical shape in which notches are formed, or a C-ring shape.

4. The connector fitting body according to claim 1, wherein the male-side connector further includes a cover portion that is slidable in the male-side connector in the longitudinal direction thereof and is rotatable in a circumferential direction thereof, wherein the cover portion includes a male-side engagement portion on which a screw thread is formed at a position corresponding to the female-side engagement portion, wherein the screw thread of the cover portion is capable of being screwed with the screw thread of the female-side engagement portion of the female-side connector in a case where the cover portion moves to the side of the female-side connector, and wherein the screw thread of the cover portion is configured not to interfere with the screw thread of the female-side engagement portion of the female-side connector in a case where the cover portion moves to a side opposite to the side of the female-side connector.

5. The connector fitting body according to claim 1, wherein in the case of the first electrical connection state, an inner circumferential surface of the holder includes a region not facing to the screw thread of the female-side connector in a radial direction of the holder.

6. A connector capable of fitting another connector on one end portion of the connector, the other connector including a terminal and a cylindrical member positioned outside of the terminal, the cylindrical member of the other connector having an outer circumferential surface on which a screw thread is formed and an inner circumferential surface that is opposite to the outer circumferential surface and that faces the terminal, the connector comprising an electrically connecting terminal pin which is inserted into the terminal of the other connector, and an engagement portion that engages with the cylindrical member of the other connector, the engagement portion including a first engagement portion and a second engagement portion, wherein the first engagement portion includes a first engagement surface which comes into contact with the outer circumferential surface of the cylindrical member of the other connector during engagement, wherein the second engagement portion includes a second engagement surface which comes into contact with the inner circumferential surface of the cylindrical member of the other connector during the engagement, wherein the first engagement surface and the second engagement surface are opposite to each other and sandwich the cylindrical member of the other connector therebetween, wherein the first engagement portion includes a holding portion on a side toward the one end portion of the connector with respect to the second engagement portion, the holding portion having a diameter of an inner circumference which is increasable by coming into contact with the screw thread on the outer circumferential surface of the cylindrical member of the other connector, wherein the first engagement surface of the first engagement portion includes a first region on which a screw thread is formed and a second region positioned adjacent to the first region and on the side toward the one end portion of the connector with respect to the second engagement portion, wherein the second region is in a position to sandwich the holding portion with the outer circumferential surface of the other connector, wherein the engagement portion is configured to be slidable in a longitudinal direction of the connector and rotatable in a circumferential direction of the connector, and wherein the connector is capable of having a plurality of electrical connection states of the terminal of the other connector and the electrically connecting terminal pin of the connector, the plurality of electrical connection states including:

a first electrical connection state in which the terminal of the other connector is electrically connected with the electrically connecting terminal pin of the connector in a case where the engagement portion slides into a side of one end of the other connector and the screw thread of the connector is screwed with the screw thread of the other connector; and a second electrical connection state in which the terminal of the other connector is electrically connected with the electrically connecting terminal pin of the connector in case where the engagement portion slides into an opposite side to the one end of the other connector and the screw thread of the connector is not screwed with the screw thread of the other connector and the screw thread of the other connector is held down by the holding portion.

7. The connector according to claim 6, wherein the holding portion includes a non-metal.

8. The connector according to claim 7, wherein the holding portion includes polyacetal, polyether ether keton, or polytetrafluoroethylene.

9. The connector according to claim 7, wherein the first engagement portion includes a coupling portion of a metal.

10. The connector according to claim 6, wherein the holding portion has an O-ring shape.

11. The connector according to claim 6, wherein the holding portion has a C-ring shape or a cylindrical shape in which notches are formed.

12. The connector according to claim 6, wherein the first engagement portion is formed so as not to overlap the second engagement portion in a longitudinal direction of the connector.

13. The connector according to claim 6, further comprises a cover portion that is slidable in a longitudinal direction of the connector and is rotatable in a circumferential direction of the connector, wherein the cover portion includes the first engagement portion on which a screw thread is formed at a position corresponding to the outer circumferential surface of the cylindrical member of the other connector, wherein the screw thread of the cover portion is capable of being screwed with the screw thread of the outer circumferential surface of the cylindrical member of the other connector in a case where the cover portion moves to a side of the other connector, and wherein the screw thread of the cover portion is configured not to interfere with the screw thread of the outer circumferential surface of the cylindrical member of the other connector in a case where the cover portion moves to a side opposite to the side of the other connector.

14. A cable connector assembly comprising:

the connector according to claim 6; and a coaxial cable.

15. A connector fitting body comprising:

the connector according to claim 6; and another connector fitted to the connector.

16. A connector fitting body comprising:

a first connector; and a second connector fitted to one end portion of the first connector, wherein the second connector includes a terminal and a cylindrical member positioned outside of the terminal, the cylindrical member having an outer circumferential surface on which a screw thread is formed and an inner circumferential surface that is opposite to the outer circumferential surface and that faces the terminal, wherein the first connector includes an electrically connecting terminal pin which is inserted into the terminal of the second connector, an outer engagement portion having an outer engagement surface that faces the outer circumferential surface of the cylindrical member of the second connector, and an inner engagement portion having an inner circumferential engagement surface that comes into contact with the inner circumferential surface of the cylindrical member of the second connector and that extends along an axis of the first connector in a sectional view, the outer engagement surface and the inner engagement surface sandwiching the cylindrical member of the second connector therebetween, wherein the connector fitting body comprises a holding portion at a position between the outer engagement portion of the first connector and the screw thread on the outer circumferential surface of the cylindrical member of the second connector and on the one end portion of the first connector with respect to the second connector, the holding portion having a lower hardness than the cylindrical member of the second connector, wherein the outer engagement portion of the first connector is configured to be slidable in a longitudinal direction of the first connector and rotatable in a circumferential direction of the first connector, the outer engagement portion of the first connector has a first region on an inner surface of which a screw thread is formed and a second region positioned between the first region and an end portion of the first connector and on which the holding portion is provided, and wherein the connector fitting body is configured to have a plurality of electrical connection states of the terminal of the second connector and the electrically connecting terminal pin of the first connector, the plurality of electrical connection states including:

a first electrical connection state in which the terminal of the second connector is electrically connected with the electrically connecting terminal pin of the first connector in a case where the outer engagement portion slides into a side of the second connector and the screw thread of the first connector is screwed with the screw thread of the second connector; and a second electrical connection state in which the terminal of the second connector is electrically connected with the electrically connecting terminal pin of the first connector in case where the outer engagement portion slides into an opposite side to the side of the second connector and the screw thread of the first connector is not screwed with the screw thread of the second connector and the screw thread of the second connector is held down by the holding portion.

17. A system comprising:

a device; and the connector fitting body according to claim 16.

* * * * *